US010440783B2

(12) United States Patent
Blasco Rueda et al.

(10) Patent No.: US 10,440,783 B2
(45) Date of Patent: Oct. 8, 2019

(54) COOKING APPLIANCE DEVICE HAVING A SELF-CONTROLLING BYPASSING UNIT

(71) Applicant: BSH Hausgeräte GmbH, Munich (DE)

(72) Inventors: Nicolas Blasco Rueda, Saragossa (ES); Alvaro Cortes Blanco, Saragossa (ES); Oscar Garcia-Izquierdo Gango, Saragossa (ES); Pablo Jesus Hernandez Blasco, Saragossa (ES); Diego Puyal Puente, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 492 days.

(21) Appl. No.: 15/122,937

(22) PCT Filed: Mar. 19, 2015

(86) PCT No.: PCT/IB2015/052015
§ 371 (c)(1),
(2) Date: Sep. 1, 2016

(87) PCT Pub. No.: WO2015/145309
PCT Pub. Date: Oct. 1, 2015

(65) Prior Publication Data

US 2017/0105250 A1 Apr. 13, 2017

(30) Foreign Application Priority Data

Mar. 24, 2014 (ES) ..... 201430407

(51) Int. Cl.
*H05B 6/12* (2006.01)
*H05B 1/02* (2006.01)
*H05B 6/06* (2006.01)

(52) U.S. Cl.
CPC ..... *H05B 6/1209* (2013.01); *H05B 1/0266* (2013.01); *H05B 6/062* (2013.01)

(58) Field of Classification Search
CPC ..... H05B 1/0266; H05B 6/1209; H05B 6/062
USPC ..... 219/490, 492, 620, 622, 624, 661, 668
See application file for complete search history.

(56) References Cited

U.S. PATENT DOCUMENTS 3,686,475 A * 8/1972 Mikkola ..... B05B 7/1686 219/482
4,438,311 A * 3/1984 Tazima ..... H05B 6/062 219/626
4,443,690 A * 4/1984 Payne ..... F24C 15/106 219/442
4,514,619 A * 4/1985 Kugelman ..... B64D 15/14 219/202
4,551,618 A * 11/1985 Payne ..... G05D 23/1917 219/486

(Continued)

OTHER PUBLICATIONS

International Search Report PCT/IB2015/052015 dated Jun. 22, 2015.

*Primary Examiner* — Jimmy Chou
(74) *Attorney, Agent, or Firm* — Michael E. Tschupp; Andre Pallapies; Brandon G. Braun

(57) ABSTRACT

A cooking appliance apparatus includes at least one mechanical switch, and at least one driver circuit configured to activate the at least one mechanical switch. The at least one driver circuit includes a protection unit and a bypassing unit, which bypasses the protection unit at least partially in at least one operating state. The bypassing unit is configured as self-controlling.

21 Claims, 3 Drawing Sheets

(56) References Cited

U.S. PATENT DOCUMENTS 4,586,028 A * 4/1986 McKinzie ..... G08B 13/18 307/10.2
6,013,901 A * 1/2000 Lavoie ..... A47G 19/2227 219/432
6,340,879 B1 * 1/2002 Blacker ..... H01M 10/48 219/201
6,630,894 B1 * 10/2003 Boyd ..... H03K 17/964 310/311
7,557,590 B2 * 7/2009 Yakabe ..... H04R 3/00 324/664
7,974,113 B2 * 7/2011 Shimada ..... H05B 6/04 219/661
8,872,074 B2 * 10/2014 Recio ..... D06F 58/28 219/494
9,040,880 B2 * 5/2015 Potter ..... F24H 9/2028 219/492
2002/0105376 A1 * 8/2002 Bardouillet ..... G01S 13/758 329/358
2002/0113065 A1 * 8/2002 Maung ..... H05B 7/12 219/620
2004/0155754 A1 * 8/2004 Fischer ..... G06K 19/0701 340/10.34
2006/0250262 A1 * 11/2006 Song ..... H01M 10/482 340/636.15
2008/0197815 A1 * 8/2008 Liebstueckel ..... H02J 7/0034 322/5
2009/0109003 A1 * 4/2009 Tucker ..... H03H 7/40 340/10.1
2010/0073178 A1 * 3/2010 Huang ..... H01H 83/04 340/664
2011/0132899 A1 * 6/2011 Shimomugi ..... H02M 3/1584 219/620
2011/0226756 A1 * 9/2011 Arnal Valero ..... H05B 6/065 219/622
2011/0233199 A1 * 9/2011 Garcia Jimenez ..... H05B 6/065 219/661
2011/0240632 A1 * 10/2011 Anton Falcon ..... H05B 6/04 219/601
2012/0125918 A1 * 5/2012 Bernal Ruiz ..... H05B 6/062 219/622
2012/0154167 A1 * 6/2012 Jones ..... H02H 9/042 340/815.45
2012/0205365 A1 * 8/2012 Anton Falcon ..... H05B 6/065 219/620
2013/0043239 A1 * 2/2013 Anton Falcon ..... H05B 6/062 219/620
2013/0043329 A1 * 2/2013 Bradbury ..... B65D 83/285 239/302
2013/0206750 A1 * 8/2013 Anton Falcon ..... H05B 6/062 219/622
2013/0213951 A1 * 8/2013 Boedicker ..... H05B 1/0263 219/413
2013/0277362 A1 * 10/2013 Ribarich ..... H05B 6/062 219/620
2014/0334047 A1 * 11/2014 Ahn ..... H02H 1/06 361/56
2017/0079092 A1 * 3/2017 Anton Falcon ..... H05B 6/065

* cited by examiner

COOKING APPLIANCE DEVICE HAVING A SELF-CONTROLLING BYPASSING UNIT

CROSS-REFERENCES TO RELATED APPLICATIONS

This application is the U.S. National Stage of International Application No. PCT/IB2015/052015, filed Mar. 19, 2015, which designated the United States and has been published as International Publication No. WO 2015/145309 and which claims the priority of Spanish Patent Application, Serial No. P201430407, filed Mar. 24, 2014, pursuant to 35 U.S.C. 119(a)-(d).

BACKGROUND OF THE INVENTION

Cooktops comprising a relay and a driver circuit, which is provided to activate the relay, are known from the prior art, the driver circuit having an overvoltage protection circuit, which comprises a freewheeling diode and a Zener diode, and a switch bypassing the Zener diode. A control unit is also provided to activate the switch directly by means of a control signal in at least one operating state in order to bypass the Zener diode.

BRIEF SUMMARY OF THE INVENTION

The object of the invention is in particular to provide a generic cooking appliance apparatus with improved attributes in respect of efficiency and/or activation. The object is achieved by the characterizing features of the independent claim 4, while advantageous embodiments and developments of the invention will emerge from the subclaims.

The invention is based on a cooking appliance apparatus, in particular a cooktop apparatus, preferably an induction cooktop apparatus, with at least one mechanical switch, at least one driver circuit, which is provided to activate the at least one mechanical switch and which comprises a protection unit and a bypassing unit, which is provided to bypass the protection unit at least partially, in particular to bypass at least one, preferably discrete, component of the protection unit in at least one operating state.

It is proposed that the bypassing unit is configured as self-controlling.

A "cooking appliance apparatus" refers in particular to at least a part, in particular a subassembly, of a cooking appliance in particular of a cooktop and preferably of an induction cooktop. In particular the cooking appliance apparatus can also comprise the entire cooking appliance, in particular the entire cooktop and preferably the entire induction cooktop. The cooking appliance apparatus preferably comprises at least one inverter and at least one inductor, which is provided to be supplied with a high-frequency heating current from the at least one inverter. The high-frequency heating current is provided in particular to heat, in particular cookware, in particular by means of eddy current and/or magnetization change effects. In particular the cooking appliance apparatus has a control unit. "Provided" means in particular specifically programmed, designed and/or equipped. That an object is provided for a specific function means in particular that the object satisfies and/or performs said specific function in at least one application and/or operating state. The at least one mechanical switch is configured in particular as a contactor and/or preferably as a relay and comprises in particular at least one driver coil and at least one armature element that can in particular be moved by means of a magnetic field generated by the at least one driver coil. In particular the at least one mechanical switch here can be configured as an on switch, in particular an SPST switch, DPST switch, SPCO switch and/or SPTT switch, and/or as a toggle switch, in particular an SPDT switch, DPDT switch and/or DPCO switch. The at least one mechanical switch here is preferably arranged between the at least one inverter and the at least one inductor and is provided in particular to break and/or establish a least one conduction path between the at least one inverter and the at least one inductor in at least one operating state. A "conduction path" in this context refers in particular to an electrically conducting connection between at least two points. A "driver circuit" refers in particular to a circuit which is provided to supply at least one switching current and/or at least one switching voltage for the at least one mechanical switch, in particular the at least one driver coil of the at least one mechanical switch. In particular the at least one driver circuit can have just discrete components and is in particular free of ICs. A "protection unit" refers in particular to a unit and/or a circuit, which is provided to protect at least one component, in particular of the at least one driver circuit, in particular from an overcurrent and/or preferably an overvoltage, in particular in at least one incorrect operating state and/or in at least one switching state, in particular in at least one off state of the at least one mechanical switch. The protection unit here can comprise at least one switch, at least one resistor, preferably a temperature-dependent resistor, in particular an NTC resistor and/or a PTC resistor, at least one safety fuse, at least one bimetallic element, at least one RC element, in particular a snubber element and/or a Boucherot element, at least one varistor and/or preferably at least one diode. The protection unit is preferably provided to withstand at least one switching operation, preferably every switching operation, of the at least one mechanical switch undamaged. A "switching operation" in this context refers in particular to an operation in which the at least one armature element of the at least one mechanical switch undergoes movement and in which the at least one mechanical switch changes its switch state in particular. In particular the at least one mechanical switch is in a non-conducting and/or bouncing state during the at least one switching operation. In particular the at least one switching operation can comprise a release of at least one electrically conducting connection the switch has in at least one operating state and/or an, in particular complete, establishing of at least one, in particular further, electrically conducting connection. A "switching state" also refers in particular to a state of the at least one mechanical switch and/or at least one control signal of the at least mechanical switch, in particular at least one rest state, at least one on state, at least one holding state and/or at least one off state. The at least one rest state here is defined in particular by a normal state, in particular an NC (normally closed) state and/or an NO (normally open) state. The at least one on state comprises in particular at least a provision of a voltage and/or a current for the at least one driver coil and/or a supply of energy to the at least one driver coil, in particular a supply of a voltage and/or a current, and/or at least one, preferably just one, switching operation, which preferably moves the at least one mechanical switch from a normal operating state to a working operating state, with the at least one armature element in particular transitioning from a rest contact to a working contact. The at least one holding state comprises in particular a holding of the at least one mechanical switch, in particular the at least one armature element, preferably in the working operating state. The at least one off state further comprises in particular at least one, preferably just one, switching operation, which preferably moves the at least one mechanical switch from a working operating state to a normal operating state, with the at least one armature element in particular transitioning from a working contact to a rest contact, and/or at least a reduction of an energy, in particular of a current and/or a voltage, in particular stored in the at least one driver coil. A "bypassing unit" refers in particular to a unit and/or circuit, which is provided to circumvent an object, in particular at least one, preferably discrete, component by means of an electrical connection. In particular in at least one operating state the bypassing unit provides at least one low-resistance conduction path, at least one low-resistance component and/or at least one component, which is provided to take on a low-resistance state in at least one operating state. The bypassing unit can advantageously have at least one, preferably voltage-controlled, bypassing switch, in particular a thyristor and/or a transistor, in particular a bipolar transistor and/or a MOSI-ET, which can be connected in particular parallel to the object. The at least one bypassing unit is preferably configured as a unipolar switch and/or unidirectional switch. Alternatively however the at least one bypassing switch can also be configured as bidirectional. The term "low-resistance" in this context means in particular an electrical resistance of maximum 10Ω, advantageously maximum 5Ω, preferably maximum 100 mΩ and particularly preferably maximum 10 mΩ. That the at least one bypassing unit is configured as "self-controlling" means in particular that in at least one operating state the at least one bypassing unit changes its state automatically and independently, in particular as a function of an, in particular instantaneous, voltage value and/or current value of the at least one driver circuit. In particular the at least one bypassing unit is free of an, in particular direct, connection to the control unit. This embodiment provides a generic cooking appliance apparatus with improved attributes in respect of efficiency and activation. Overvoltages, in particular at the at least one mechanical switch, can also advantageously be avoided, thus allowing in particular sensitive components to be protected. In particular an off operation of the at least one mechanical switch can be made faster and a temperature dependence of the at least one mechanical switch can advantageously be minimized Reduced spontaneous heating of the at least one mechanical switch can be achieved and costs minimized. The bypassing unit preferably has at least two, preferably just two, bypassing connectors and at least one, preferably just one, control connector. A "bypassing connector" in this context refers in particular to a connector, in particular an input and/or output, of the bypassing unit, which is connected to at least one connector of at least one object to be bypassed. In particular the at least two bypassing connectors are connected to one another in a low-resistance manner at least in one operating state, in particular a bypassing state. The at least two bypassing connectors are also connected to one another in a high-resistance manner at least in a further operating state that is different in particular from the at least one operating state, in particular the bypassing state, in particular a blocking state. The term "high-resistance" in this context refers in particular to an electrical resistance of at least 500Ω, advantageously at least 1 kΩ, preferably at least 5 kΩ and particularly preferably at least 10 kΩ. A "control connector" in this context refers in particular to a connector, in particular an input, of the bypassing unit, which is provided to change a state of the at least one bypassing unit, in particular a presence and/or absence of a low-resistance connection between the at least two bypassing connectors, as a function of at least one signal present, in particular an electrical potential and/or a current. In particular the at least one control connector is free of an, in particular direct, connection to the control unit. The at least one control connector can also be configured in an identical manner in particular to at least one of the bypassing connectors. This allows in particular an economical and compact bypassing unit to be produced, which can be assembled in particular quickly and easily.

If the bypassing unit is configured to be current controlled, it is advantageously possible to achieve simple and in particular autonomous control of the bypassing unit.

It is further proposed that, in the event of an at least essentially vanishing current strength through the at least one control connector, the bypassing unit is provided to bypass the protection unit at least partially. An "at least essentially vanishing current strength" here refers in particular to a current strength of maximum 500 mA, in particular maximum 100 mA, preferably maximum 10 mA and particularly advantageously maximum 1 mA. This further simplifies control of the bypassing unit in particular.

In one embodiment of the invention it is proposed that the bypassing unit has at least one energy storage unit which defines at least one, in particular temporal, parameter for bypassing the protection unit in at least one operating state. An "energy storage unit" here refers in particular to a unit, which is provided to store in particular electrical energy in at least one operating state. The at least one energy storage unit can be configured for example as a battery, accumulator, inductance and/or advantageously as a capacitor. This advantageously allows a state of the bypassing unit to be matched to different control options.

The at least one parameter could be for example a bypassing inertia. A "bypassing inertia" here refers in particular to a time period between activation and the start of bypassing. The at least one parameter is preferably defined by a bypassing time period. The bypassing time period is in particular maximum 500 μs, advantageously maximum 100 μs, preferably maximum 50 μs and particularly preferably maximum 20 μs. This means in particular that the bypassing unit can be matched to different control variants in a simple manner It is further proposed that the control unit is provided to supply at least one, preferably just one, control signal to control a switching state of the at least one mechanical switch. This allows a switching state of the at least one mechanical switch to be changed in an advantageously simple manner.

It is further proposed that the at least one control signal is at least partially a pulse width modulated signal. In particular the pulse width modulated signal can have different duty factors for different time ranges. A "duty factor" here refers in particular to a ratio of a time period, during which a, preferably periodic, control signal of the control unit has an on value, in particular a high level, to a cycle duration of the control signal. This allows in particular simple and advantageously efficient activation of the at least one mechanical switch.

If the bypassing time period corresponds to a time period for which the pulse width modulated signal has at least one low level, it is possible in particular to increase efficiency and improve off behavior.

It is further proposed that the protection unit comprises at least one consumer unit, in particular a resistor and/or preferably a Zener diode. This allows an off operation of the at least one mechanical switch in particular to be performed faster. It is also advantageously possible to minimize a temperature dependence of the at least one mechanical switch.

If the bypassing unit is provided to bypass the at least one consumer unit, an off operation of the at least one mechanical switch can be performed faster in an advantageously simple manner.

BRIEF DESCRIPTION OF THE DRAWINGS

Further advantages will emerge from the description of the drawing which follows. The drawing shows an exemplary embodiment of the invention. The drawing, description and claims contain numerous features in combination. The person skilled in the art will expediently also consider the features individually and combine them in useful further combinations.

DETAILED DESCRIPTION OF EXEMPLARY EMBODIMENTS OF THE PRESENT INVENTION

Figure 1:
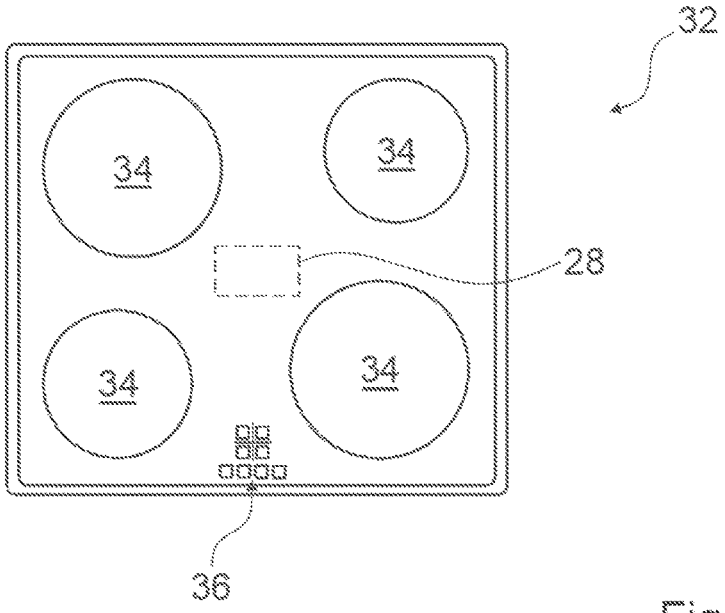
FIG. 1 shows a top view of a cooking appliance configured as an induction cooktop with four heating zones and a cooking appliance apparatus.

FIG. 1 shows a schematic top view of a cooking appliance 32 configured by way of example as an induction cooktop. In the present instance the cooking appliance 32 has a cooktop plate with four heating zones 34. Each heating zone 34 is provided to heat just one cookware element (not shown). The cooking appliance 32 also comprises a cooking appliance apparatus. The cooking appliance apparatus has an operating unit 36. The operating unit 36 allows a user to input and/or select a power stage. The cooking appliance apparatus has a control unit 28 to control a heating power. The control unit 28 has a computation unit, a storage unit and an operating program stored in the storage unit, which is provided to be executed by the computation unit.

Figure 2:
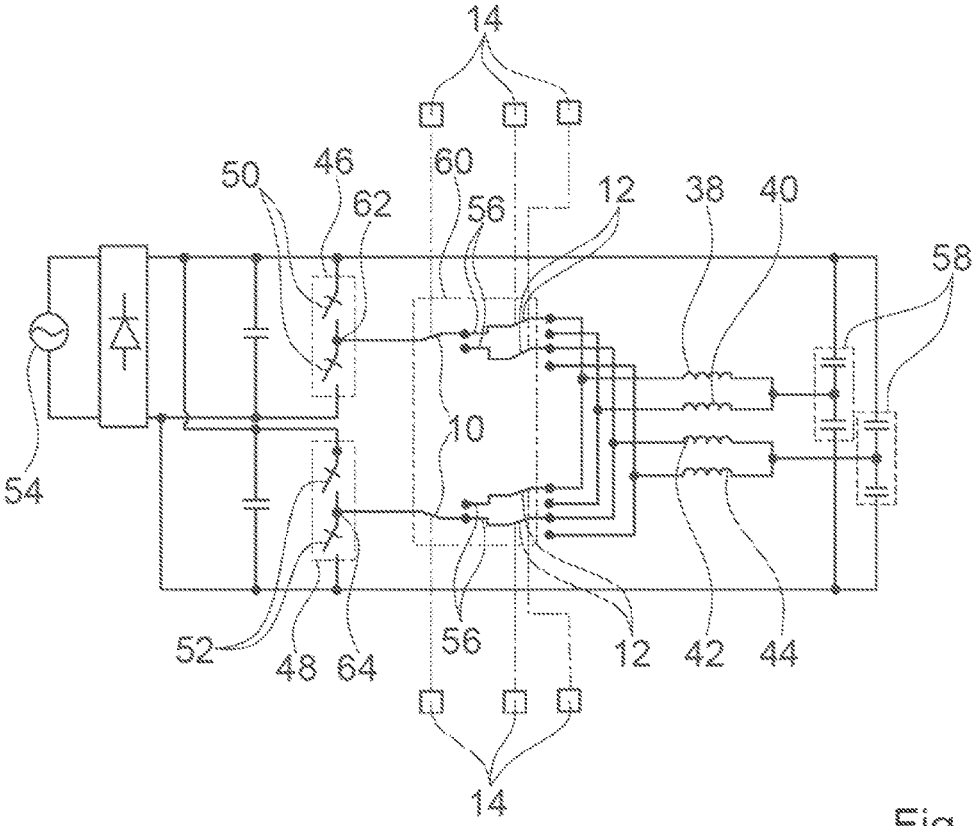
FIG. 2 shows a schematic circuit diagram of the cooking appliance apparatus with six mechanical switches.

FIG. 2 shows a schematic circuit diagram of the cooking appliance apparatus. The cooking appliance apparatus has four inductors 38, 40, 42, 44. Each inductor 38, 40, 42, 44 is assigned to one of the heating zones 34. The cooking appliance apparatus further comprises two inverters 46, 48. The inverters 46, 48 are configured identically to one another. Each inverter 46, 48 has two semiconductor switches 50, 52, in particular IGBTs. The control unit 28 is connected (not shown) to control connectors of the semiconductor switches 50, 52. Each of the inverters 46, 48 is provided to convert a pulsing rectified network voltage of an energy source 54 to a high-frequency heating current and in particular to supply it to at least one of the inductors 38, 40, 42, 44. To this end the cooking appliance apparatus has a number of conduction paths 56. In the present instance each of the inverters 46, 48 is connected to the inductors 38, 40, 42, 44 by way of conduction paths 56. The cooking appliance apparatus also has two resonance units 58. Each of the resonance units 58 is part of an electric oscillating circuit and can be charged by way of the associated inverters 46, 48.

The cooking appliance apparatus also has a switching arrangement 60. The switching arrangement 60 comprises a number of mechanical switches 10, 12. The mechanical switches 10, 12 are provided to break and/or establish the conduction paths 56 between the inverters 46, 48 and the inductors 38, 40, 42, 44. In the present instance the switching arrangement 60 comprises six mechanical switches 10, 12. The mechanical switches 10, 12 are of identical structure. The mechanical switches 10, 12 are configured as toggle switches. The mechanical switches 10, 12 are configured as relays in the present instance. Each of the conduction paths 56 can be broken by two mechanical switches 10, 12. Two first mechanical switches 10 are connected respectively to a heating current output 62, 64 of the inverters 46, 48. The two first mechanical switches 10 are also connected respectively to two second mechanical switches 12. The two second mechanical switches 12 are connected respectively to one of the inductors 38, 40, 42, 44.

The cooking appliance apparatus also has a number of driver circuits 14. Each driver circuit 14 is provided to activate one of the mechanical switches 10, 12. In the present instance the driver circuits 14 are configured identically to one another. One of the driver circuits 14 is assigned to each of the mechanical switches 10, 12. Each of the mechanical switches 10, 12 is connected to one of the driver circuits 14. Alternatively it is also conceivable to configure at least one driver circuit differently. Also a single driver circuit could be assigned to at least two mechanical switches.

The cooking appliance apparatus can also comprise further units, for example rectifiers, filters, detectors, in particular current detectors and/or voltage detectors, and or voltage converters.

Figure 3:
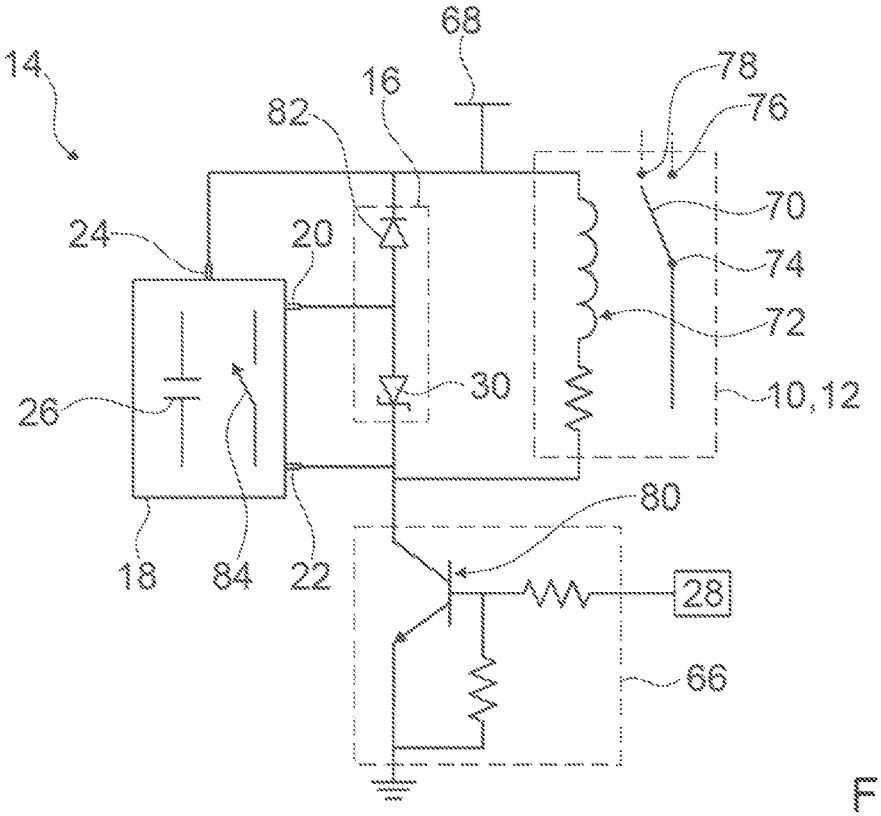
FIG. 3 shows a schematic circuit diagram of one of the mechanical switches and a driver circuit for activating the mechanical switch.

FIG. 3 shows an exemplary schematic circuit diagram of one of the mechanical switches 10, 12 and one of the driver circuits 14 from FIG. 2. The description which follows uses the example of one of the mechanical switches 10, 12 and can in particular be applied to the other mechanical switches 10, 12.

The mechanical switch 10, 12 has an armature element 70. The armature element 70 is made of a ferromagnetic material. The mechanical switch 10, 12 also has a driver coil 72. In the present instance the driver coil 72 has a ferromagnetic core. Alternatively a driver coil 72 can also be configured without a ferromagnetic core and/or have a core of a different material. In at least one operating state the driver coil 72 is provided to attract the armature element 70, in particular by means of a magnetic force. The mechanical switch 10, 12 has three contacts. A first contact is configured as a switching contact 74. The switching contact 74 is connected indirectly and/or directly to one of the two heating current outputs 62, 64. A second contact is configured as a rest contact 76. The rest contact 76 is connected indirectly and/or directly to one of the inductors 38, 40, 42, 44. A third contact is configured as a working contact 78. The working contact 78 is connected indirectly and/or directly to one of the inductors 38, 40, 42, 44.

The driver circuit 14 comprises a driver unit 66. The driver unit 66 serves to activate the driver circuit 14. The driver unit 66 is provided to control a function of the driver circuit 14. The driver unit 66 has three connectors. The driver circuit 14 also has a protection unit 16. The protection unit 16 is provided to protect the mechanical switch 10, 12 from overvoltage. The protection unit 16 is also provided to protect the driver unit 66 from overvoltage. The protection unit 16 has three connectors. The driver circuit 14 also has a bypassing unit 18. The bypassing unit 18 has three connectors 20, 22, 24. In the present instance the bypassing unit 18 has two bypassing connectors 20, 22 and one control connector 24. The cooking appliance apparatus also has a supply unit (not shown). The supply unit is provided to supply a supply voltage for the driver circuit 14. To this end a supply connector 68 is connected to the driver circuit 14. The mechanical switch 10, 12 is also connected to the driver circuit 14. To this end the mechanical switch 10, 12 has two connectors.

The supply connector 68 is connected to a first connector of the driver coil 72. The supply connector 68 is connected to a first connector of the protection unit 16. The supply connector 68 is also connected to the control connector 24 of the bypassing unit 18.

The first connector of the driver coil 72 is connected to a first connector of the protection unit 16. The first connector of the driver coil 72 is also connected to the control connector 24 of the bypassing unit 18. A second connector of the driver coil 72 is connected to a first connector of the driver unit 66. The second connector of the driver coil 72 is connected to a third connector of the protection unit 16. The second connector of the driver coil 72 is also connected to the second bypassing connector 22 of the bypassing unit 18.

The first connector of the protection unit 16 is connected to the control connector 24 of the bypassing unit 18. A second connector of the protection unit 16 is connected to the first bypassing connector 20 of the bypassing unit 18. The third connector of the protection unit 16 is connected to the second bypassing connector 22 of the bypassing unit 18. The third connector of the protection unit 16 is also connected to the first connector of the driver unit 66.

The second bypassing connector 22 of the bypassing unit 18 is also connected to the first connector of the driver unit 66. A second connector of the driver unit 66 is connected to the control unit 28. A third connector of the driver unit 66 is also connected to a ground connector. Alternatively or additionally a third connector of a driver unit can also be grounded.

The driver unit 66 has at least one control switch 80. In the present instance the control switch 80 is configured as a bipolar transistor. The control switch 80 is connected to the second connector of the driver unit 66 with a base contact by way of a resistor. The control switch 80 is also connected to the ground connector with an emitter contact. The control switch 80 is connected to the first connector of the driver unit 66 with a collector contact. The driver unit 66 can also have at least one further component, for example in particular at least one electrical resistor and/or at least one capacitor.

The protection unit 16 has a freewheeling diode 82. The protection unit 16 also has a consumer unit 30. In the present instance the consumer unit 30 is configured as a Zener diode. The freewheeling diode 82 is connected to the first connector of the protection unit 16 with a cathode contact. The freewheeling diode 82 is connected to the second connector of the protection unit 16 with an anode contact. The consumer unit 30 is connected to the third connector of the protection unit 16 with a first contact, in particular a cathode contact. The consumer unit 30 is connected to the second connector of the protection unit 16 with a second contact, in particular an anode contact. The consumer unit 30 is also connected to the anode contact of the freewheeling diode 82 with the second contact, in particular the anode contact.

In the present instance the bypassing unit 18 has at least one bypassing switch 84. The bypassing unit 18 also has an energy storage unit 26. In the present instance the energy storage unit 26 is configured as a capacitor. The energy storage unit 26 here is actively connected to the bypassing switch 84. The bypassing unit 18 can also have at least one further component, for example in particular at least one electrical resistor and/or at least one capacitor.

The bypassing unit 18 is provided to bypass the protection unit 16 at least partially in at least one operating state. To this end the bypassing unit 18 is configured as self-controlling. The bypassing unit 18 is therefore free of direct connections to the control unit 28. The bypassing unit 18 is also provided to bypass the consumer unit 30 in the at least one operating state. In the present instance the bypassing switch 84 is provided to bypass the consumer unit 30 in the at least one operating state.

To this end the bypassing unit 18 is configured as current-controlled. A bypassing state of the bypassing unit 18 here can be changed as a function of a current flowing through the control connector 24 of the bypassing unit 18.

The control unit 28 is also provided to supply a control signal to control a switching state of the mechanical switch 10, 12. The control signal of the control unit 28 here is present at the second connector of the driver unit 66.

Figure 4:
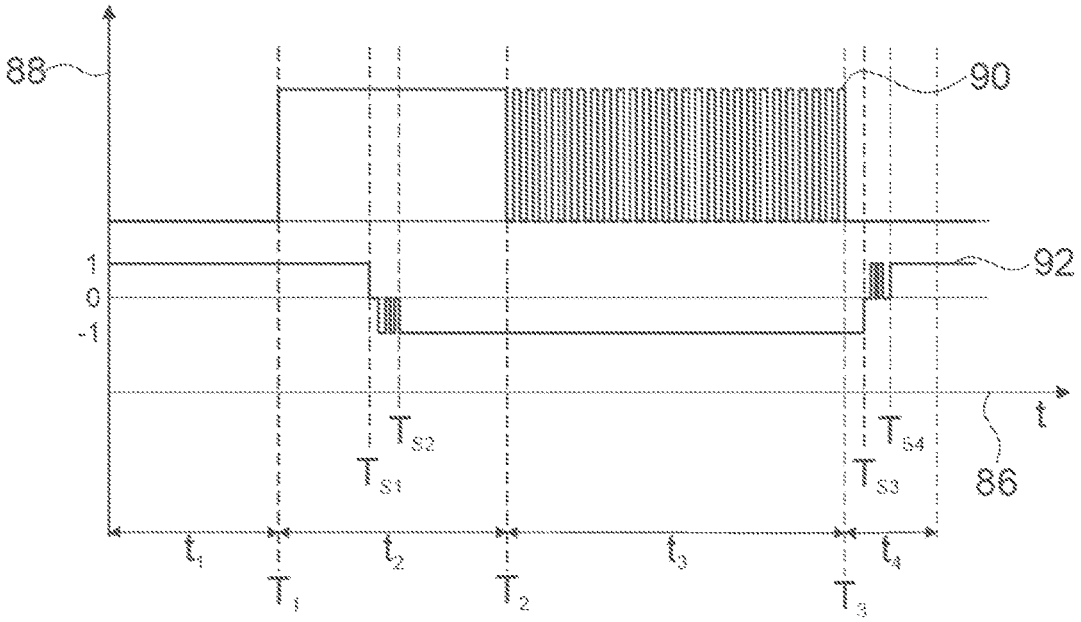
FIG. 4 shows a schematic diagram of a control signal for controlling a switching state of the at least one mechanical switch.

FIG. 4 shows a schematic diagram of the control signal for controlling a switching state of the mechanical switch 10, 12 and associated switching operations of the mechanical switch 10, 12. The time is shown on an x-axis 86. A y-axis 88 is the size axis. A curve 90 shows the control signal supplied by the control unit 28. In the present instance the control signal is at least partially defined by a pulse width modulated signal. The control signal can therefore have at least one high level and at least one low level. A curve 92 shows the switching operations. A "1" level defines a conducting connection between the switching contact 74 and the rest contact 76 of the mechanical switch 10, 12. A "−1" level defines a conducting contact between the switching contact 74 and the working contact 78 of the mechanical switch 10, 12. A "0" level defines a non-conducting state.

During a first time interval $t_1$ the control signal has the low level. In this rest state the control switch 80 is open and therefore non-conducting. There is no current flowing into the control connector 24 of the bypassing unit 18. The bypassing connectors 20, 22 here are connected in a high-resistance manner In particular the bypassing switch 84 is non-conducting. The driver coil 72 is also free of current. The switching contact 74 of the mechanical switch 10, 12 is also connected to the rest contact 76 in a conducting manner At a time point $T_1$ the control signal changes. During a second time interval $t_2$ the control signal has the high level. In this on state the control switch 80 is closed and therefore conducting. A partial current flows into the control connector 24 of the bypassing unit 18. The bypassing connectors 20, 22 here are connected in a low-resistance manner. In particular the bypassing switch 84 is conducting. The partial current can therefore flow through the bypassing switch 84 and the control switch 80 to the ground connector. In the present instance the partial current can also flow through the consumer unit 30, which is in particular connected in the forward direction, and the control switch 80 to the ground connector. The partial current flowing through the bypassing unit 18 is also provided to charge the energy storage unit 26. A switching current also flows through the driver coil 72. The switching current flows through the driver coil 72 and the control switch 80 to the ground connector. In this instance a maximum mean current flows through the driver coil 72. A first switching operation takes place as a result. The armature element 70 changes position so that the switching contact 74 is connected to the working contact 78 in a conducting manner In the present instance the second time interval $t_2$ has a duration of 100 ms. The switching operation starts at a time point $T_{S1}$. The switching operation ends at a time point $T_{S2}$. By time point $T_{S2}$ the mechanical switch 10, 12 has completely finished bouncing. In the present instance a switching operation has a duration of 10 ms. The control unit 28 is preferably provided to deactivate the inverters 46, 48 at least during a switching operation.

At a time point $T_2$ the control signal changes. From time point $T_2$ the control signal is defined by a pulse width modulated signal. A duty factor of the control signal here has a value of 0.7. During an entire third time interval $t_3$ the control signal has the duty factor with the value 0.7. The control signal also has a frequency of 25 kHz. In this holding state the control signal causes the control switch 80 to close and open alternately. When the control signal has a high level operation is in the manner of the on state. When the control signal has a low level the control switch 80 is open and therefore non-conducting. There is no current flowing into the control connector 24 of the bypassing unit 18. In this instance, in particular an instance of vanishing current strength through the control connector 24, the bypassing unit 18 is provided to bypass the protection unit 16 at least partially. In the present instance the bypassing unit 18 is provided to bypass the consumer unit 30. The charging of the energy storage unit 26 here ensures that the bypassing switch 84 is conducting. The bypassing connectors 20, 22 are therefore connected in a low-resistance manner In this operating state the energy storage unit 26 is provided to define a parameter for bypassing the protection unit 16. The parameter is defined by a bypassing time period. The bypassing time period corresponds to the maximum time period for which the bypassing connectors 20, 22 are connected in a low-resistance manner as the current strength vanishes at the control connector 24. In the present instance the bypassing time period corresponds precisely to a time period for which the pulse width modulated signal has a low level. In the present instance the bypassing time period is 12 μs. The sudden switching off of the current causes a high induction voltage to pass through the driver coil 72. The protection unit 16 and/or the bypassing unit is/are provided to reduce this induction voltage. A circulating current produced by the induction voltage flows through the bypassing unit 18, the freewheeling diode 82 and the driver coil 72. The circulating current then flows through the bypassing switch 84, the freewheeling diode 82 and the driver coil 72.

During the entire third time interval $t_3$ a mean current flows through the driver coil 72. The mean current here corresponds to an, in particular minimum, required holding current. This allows the armature element 70 to be held on the working contact 78. The switching contact 74 is then connected to the working contact 78 in a conducting manner This increases efficiency and reduces the spontaneous heating of the mechanical switch 10, 12.

At a time point $T_3$ the control signal changes. During a fourth time interval $t_4$ the control signal has the low level. In this off state the control switch 80 is open and therefore non-conducting. Initially operation in the manner of the low level of the holding state takes place here. If the energy storage unit 26 of the bypassing unit 18 is at least essentially discharged, the bypassing switch 84 changes to a non-conducting state. In this instance the bypassing connectors 20, 22 are connected in a high-resistance manner The bypassing switch 84 is therefore non-conducting. The protection unit 16 is also provided to reduce the resulting induction voltage. A circulating current produced by the induction voltage flows through the consumer unit 30, the freewheeling diode 82 and the driver coil 72. This reduces an energy in the driver coil 72 effectively and in particular quickly, thereby reducing a thermal dependence of the mechanical switch 10, 12. The energy of the driver coil 72 is reduced after around 1.5 ms to 2 ms. A second switching operation also takes place. The armature element 70 changes position so that the switching contact 74 is connected to the rest contact 76 in a conducting manner. The switching operation starts at a time point $T_{S3}$. The switching operation ends at a time point $T_{S4}$. By time point $T_{S4}$ the mechanical switch 10, 12 has completely finished bouncing. The first time interval $t_1$ follows the fourth time interval $t_4$.

Figure 5:
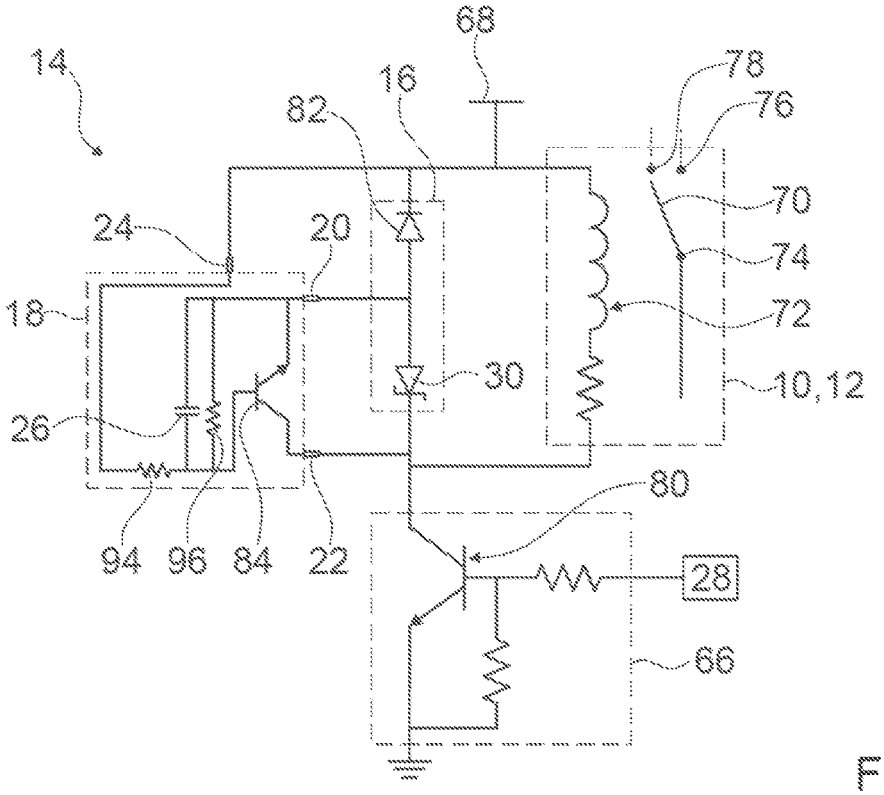
FIG. 5 shows the schematic diagram from FIG. 3 with an exemplary embodiment of a bypassing unit.

FIG. 5 shows the schematic diagram from FIG. 3 with an exemplary embodiment of the bypassing unit 18. Only the embodiment of the bypassing unit 18 is described in the following.

In the present instance the bypassing switch 84 is configured as a bipolar transistor. The energy storage unit 26, which is configured as a capacitor, has a capacitance of around 200 nF in the present instance.

The control connector 24 of the bypassing unit 18 is connected to a first contact of a first resistor 94 of the bypassing unit 18. A second contact of the first resistor 94 is connected to a base contact of the bypassing switch 84. The second contact of the first resistor 94 is connected to a first contact of the energy storage unit 26. The second contact of the first resistor 94 is also connected to a first contact of a second resistor 96 of the bypassing unit 18.

The first contact of the energy storage unit 26 is connected to the first contact of the second resistor 96. The first contact of the energy storage unit 26 is connected to the base contact of the bypassing switch 84. The first contact of the second resistor 96 is connected to the base contact of the bypassing switch 84. A second contact of the energy storage unit 26 is connected to a second contact of the second resistor 96. The second contact of the energy storage unit 26 is also connected to the first bypassing connector 20. The second contact of the energy storage unit 26 is connected to an emitter contact of the bypassing switch 84.

The second contact of the second resistor 96 is also connected to the first bypassing connector 20. The second contact of the second resistor 96 is connected to an emitter contact of the bypassing switch 84. A collector contact of the bypassing switch 84 is connected to the second bypassing connector 22.

The second resistor 96 is therefore connected parallel to the energy storage unit 26. The bypassing switch 84 is also connected parallel to the consumer unit 30.

The invention claimed is:

1. A cooking appliance apparatus, comprising:

at least one mechanical switch;

at least one driver circuit configured to activate the at least one mechanical switch, said at least one driver circuit comprising a protection unit and a self-controlling bypassing unit configured to bypass the protection unit at least partially in at least one operating state, wherein the bypassing unit includes at least one energy storage unit configured to define at least one parameter for bypassing the protection unit in at least one operating state, wherein the at least one parameter is defined by a bypassing time period; and a control unit configured to supply at least one control signal to control a switching state of the at least one mechanical switch, said at least one control signal being at least partially a pulse width modulated signal;

wherein the bypassing time period corresponds to a time period for which the pulse width modulated signal has at least one low level.

2. The cooking appliance apparatus of claim 1, further comprising a cooktop apparatus housing the control unit.

3. The cooking appliance apparatus of claim 1, wherein the bypassing unit includes at least two bypassing connectors and at least one control connector.

4. The cooking appliance apparatus of claim 1, wherein the bypassing unit is configured as current-controlled.

5. The cooking appliance apparatus of claim 3, wherein the bypassing unit is configured to bypass the protection unit at least partially in the presence of an at least essentially vanishing current strength through the at least one control connector.

6. The cooking appliance apparatus of claim 1, wherein the protection unit comprises at least one consumer unit.

7. The cooking appliance apparatus of claim 6, wherein the bypassing unit is configured to bypass the at least one consumer unit.

8. A cooking appliance, comprising at least one cooking appliance apparatus which includes:

at least one mechanical switch;

at least one driver circuit configured to activate the at least one mechanical switch, said at least one driver circuit comprising a protection unit and a self-controlling bypassing unit configured to bypass the protection unit at least partially in at least one operating state, wherein the bypassing unit includes at least one energy storage unit configured to define at least one parameter for bypassing the protection unit in at least one operating state, wherein the at least one parameter is defined by a bypassing time period; and a control unit configured to supply at least one control signal to control a switching state of the at least one mechanical switch, said at least one control signal being at least partially a pulse width modulated signal;

wherein the bypassing time period corresponds to a time period for which the pulse width modulated signal has at least one low level.

9. The cooking appliance of claim 8, wherein the bypassing unit includes at least two bypassing connectors and at least one control connector.

10. The cooking appliance of claim 8, wherein the bypassing unit is configured as current-controlled.

11. The cooking appliance of claim 9, wherein the bypassing unit is configured to bypass the protection unit at least partially in the presence of an at least essentially vanishing current strength through the at least one control connector.

12. The cooking appliance of claim 8, wherein the protection unit comprises at least one consumer unit.

13. The cooking appliance of claim 12, wherein the bypassing unit is configured to bypass the at least one consumer unit.

14. The cooking appliance apparatus of claim 6, wherein the consumer unit comprises a Zener diode.

15. The cooking appliance apparatus of claim 1, wherein the protection unit comprises a Zener diode and a freewheeling diode.

16. The cooking appliance apparatus of claim 1, wherein the bypassing unit comprises a bypass switch actively connected to the energy storage unit.

17. The cooking appliance apparatus of claim 1, wherein the energy storage unit comprises a capacitor.

18. The cooking appliance apparatus of claim 12, wherein the consumer unit comprises a Zener diode.

19. The cooking appliance apparatus of claim 8, wherein the protection unit comprises a Zener diode and a freewheeling diode.

20. The cooking appliance apparatus of claim 8, wherein the bypassing unit comprises a bypass switch actively connected to the energy storage unit.

21. The cooking appliance apparatus of claim 8, wherein the energy storage unit comprises a capacitor.

* * * * *